United States Patent [19]

Mudgett

[11] Patent Number: 4,910,361

[45] Date of Patent: Mar. 20, 1990

[54] ELECTRIC CABLE WITH BURN RESISTANT FEATURES

[75] Inventor: Donald Mudgett, Coopersville, Mich.

[73] Assignee: Lestox Inc., Birmingham, Mich.

[21] Appl. No.: 329,927

[22] Filed: Mar. 29, 1989

[51] Int. Cl.[4] ..... H01B 7/34

[52] U.S. Cl. ..... 174/121 R; 174/110 S; 174/121 A; 174/121 AR

[58] Field of Search ..... 174/110 S, 121 R, 121 A, 174/121 AR, 122 R, 122 G, 124 R, 124 G, 124 GC

[56] References Cited

U.S. PATENT DOCUMENTS

| | | | |
|---|---|---|---|
| 2,186,441 | 6/1935 | Youmans | 156/56 |
| 2,258,218 | 10/1941 | Rochow | 174/110 S |
| 2,386,466 | 2/1940 | Hyde | 174/121 A |
| 2,610,286 | 4/1949 | Cox | 338/212 |
| 2,639,247 | 11/1949 | Squier | 156/53 |
| 2,759,041 | 8/1956 | Cox | 174/121 R |
| 2,795,640 | 6/1957 | Crandall | 174/122 R |
| 2,983,700 | 9/1961 | Rohm | 528/26 |
| 2,993,949 | 7/1961 | Moebius et al. | 174/124 R |
| 3,192,309 | 11/1959 | Zoder et al. | 174/121 R |
| 3,576,940 | 5/1971 | Stone | 174/121 A X |
| 4,001,128 | 1/1977 | Penneck | 174/DIG. 1 X |
| 4,051,324 | 9/1977 | Anderson et al. | 174/121 S X |
| 4,388,127 | 6/1983 | Brunner et al. | 156/53 |
| 4,405,687 | 9/1983 | Morita et al. | 174/110 S X |
| 4,514,466 | 4/1985 | Leon, Jr. et al. | 174/122 G X |

FOREIGN PATENT DOCUMENTS

| | | | |
|---|---|---|---|
| 156607 | 5/1954 | Australia | 174/122 G |
| 2381377 | 10/1978 | France | 174/121 A |
| 35889 | 3/1977 | Japan | 174/121 A |
| 520246 | 4/1940 | United Kingdom | 174/124 GC |
| 555354 | 8/1943 | United Kingdom | 174/124 |

*Primary Examiner*—Morris H. Nimmo

*Attorney, Agent, or Firm*—Dykema Gossett

[57] ABSTRACT

An electric cable is disclosed that has improved burn resistance characteristics. The improved electric cable consists of a insulation portion that has a glass fiber yarn wrapped around the conductor. The yarn is impregnated at an outer periphery by a first silicone compound. A second silicone compound is coated about the outer periphery of the glass fiber yarn. In an alternative embodiment, a silicone tape replaces the glass fiber yarn. The improved insulation for electric cable is envisioned for use with both single strand and multi-strand wires.

10 Claims, 4 Drawing Sheets

ELECTRIC CABLE WITH BURN RESISTANT FEATURES

FIELD OF THE INVENTION

This application is related to co-pending application Ser. No. 330,008 filed Mar. 29, 1989 by the same inventor and assignee as this application.

This invention in general relates to an improved electric cable that has better burn resistant characteristics than existing electric cable.

Several types of insulation for electric cable are known that each have their own individual characteristics. In general, these insulations give off toxic fumes when burned. In the case of a fire the insulation will burn and create toxic fumes that may well be more harmful to victims of the fire than the fire itself. In addition, the prior art electric cable does not survive fires very well. When an electric cable is exposed to fire, the insulation melts and the wire short circuits. This is especially true in a multi-strand cable containing several individual electric wires. This lack of survivability of the prior art electric cable can create very real problems if the cable that melts is a control wire for controlling a system such as, for example: a computer-controlled chemical reactor, a power generation facility, or a fire alarm system.

The use of a silicone coating over a bare electric conductor is known. However, the process used to coat the wire is quite complicated and expensive. Moreover, the resulting cable is too soft and is subject to nicks and abrasions. This coating has only been used with large gauge cable and not with small control cables on which the insulation thickness is small.

It is therefore an object of the present invention to create an electric cable that has improved burn resistant characteristics.

More particularly, it is an object of the present invention to create an electric cable that, when burned, produces far less toxic smoke than ordinary electric cable.

Further, it is an object of the present invention to create an electric cable that will have better burn survivability when exposed to fire.

Moreover, it is an object of the present invention to achieve these goals with an electric cable that is relatively inexpensive and practical for most everyday uses.

SUMMARY OF THE INVENTION

The present invention discloses an improved electric cable that will produce far less toxic fumes when burned and has better survivability when exposed to fire.

More particularly, the electric cable of this invention comprises at least one electric conductor that has a glass fiber yarn wrapped around the outer periphery thereof. Fiberglass TM yarn may be utilized as the glass fiber yarn. A second wrap of yarn may be wrapped around the first wrap in an opposite orientation. A first silicone compound is then impregnated into the outer periphery of the glass fiber yarn, but is not allowed to impregnate through to the inner periphery of the yarn. The silicone compound is prevented from contacting the inner periphery of the yarn so that is does not come in contact with the electrical conductors since that will make the insulation difficult to remove or strip. A second silicone compound coating is disposed around the outside of this first silicone compound and results in an electric cable that is relatively easy to manufacture, has good burn characteristics and is resistant to abrasions.

This single electric conductor coated by the glass fiber yarn and the silicone compounds can be joined with several other similar conductors and wrapped into a multi-strand wire using the same glass fiber yarn and additional silicone coatings.

Alternatively, the wrap may be wrapped around a series of prior art electric cable to create a multi-strand cable that will have an outer insulation with the improved burn characteristics.

An alternative embodiment substitutes a silicone tape, in place of the glass fiber yarn, to wrap the electrical conductors or the single electric conductor and then applies the silicone coating outside this tape.

Further objects and features of the present invention can be best understood upon reading the attached specification and drawings, of which the following is a brief description thereof.

DETAILED DESCRIPTION OF THE PREFERRED EMBODIMENT

Figure 2:
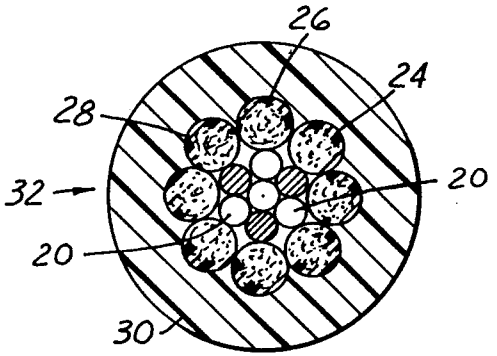
FIG. 2 is a cross-section through a multi-strand cable as disclosed by the present invention.
Figure 1:
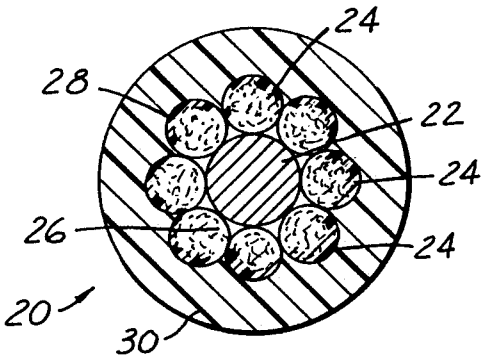
FIG. 1 is a cross-section through a single strand cable as disclosed by the present invention.

The main features of the improved electric cable of the present invention can be best understood upon review of FIGS. 1 and 2.

FIG. 1 illustrates a cross-section through an electric cable according to the present invention that insulates a single electric conductor. The improved single strand electric cable 20 has a central bare electric wire conductor 22 that is surrounded by glass fiber yarn wraps 24. It is to be understood that the wrap is illustrated in a simplified way. The actual wrap may be of a different configuration and may have several layers. A portion 26 of these wraps that is in contact with electric conductor 22 remains unimpregnated, while an outer portion 28 of wrap 24 is impregnated by a first silicone compound. An outer coating 30 of a second silicone compound is disposed around the glass fiber yarn wrap 24. Fiberglass TM yarn may be utilized as the glass fiber yarn for the wrap.

FIG. 2 illustrates the improved multi-strand electric cable 32 according to the present invention. Multi-strand cable is also known as wire-for-plennum. A plurality of insulated single wires are disposed at a central portion of the improved multi-strand cable 32 and may each individually be single strand cables according to the improved electric cable illustrated at 20 in FIG. 1. The wires 20 are shown schematically in FIG. 2, but each may be identical to that shown in FIG. 1. That is, this improved multi-strand cable 32 may be wrapped around single electric wires such as illustrated at 20, or it may be wrapped around ordinary prior art insulated wires. The improved multi-strand cable 32 comprises wraps 24 wrapped around the outer periphery of the multiple single insulated wires 20. The wrap 24 has nonimpregnated section 26 and impregnated section 28 and outer coating 30 similar to the single strand embodiment 20.

The exact composition of the various silicone compounds, compositions or mixtures will be described below. The electric cables illustrated in FIGS. 1 and 2 combines the best characteristics of a glass fiber yarn wrap that is resilient and tough and the silicone coating that will provide some flexibility and some unity to the cable. Without the coating compound the glass fiber wrap may fray and may not be adequate for use as an electric cable. Without a wrap, the silicone compound would not be tough and resistant to abrasion. The overall combination of the glass fiber yarn and silicone compound results in an insulation for an electric cable that will create a much less toxic smoke if burned. Also, if the insulation is exposed to fire, it has a much higher burning point than the standard electric cable commonly available today. In addition, if the insulation is exposed to fire and is raised beyond its burning point, the insulation is less likely to melt and short circuit the electric cable. When insulation such as is illustrated in FIGS. 1 and 2 is exposed to heat beyond its burning point the silicone compound and glass fiber yarn will usually leave an ash about the electric cable that will still provide insulation and will prevent short circuiting. This will allow the electric cable to continue to be utilized unless it is physically contacted. That is, if something happens to bump into the cable the ash will fall away and the wire may then short circuit. This is an important feature since these electric cables may be utilized as control wires for controlling such features as a fire alarm, a sprinkler system, or in aircraft. Obviously, it is important that the control wires for such systems have as much burn survivability as possible. Prior art electrical cable such as PVC and Teflon when burned, melt and fall away thus allowing the electrical system to short out.

Figure 3:
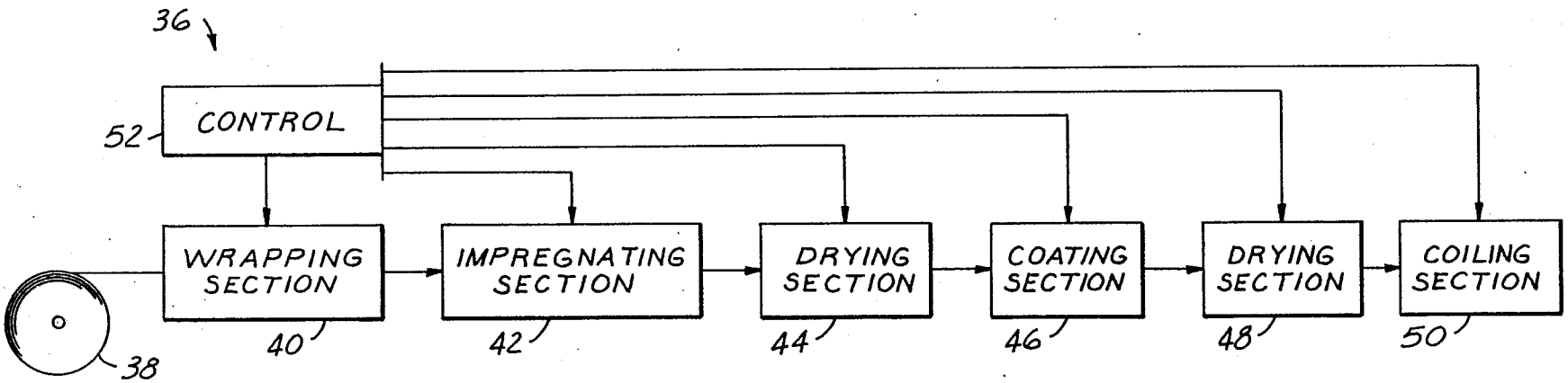
FIG. 3 is a flowchart showing the process used to create the improved electric cable of the present invention.

FIG. 3 shows a flowchart of a process for creating an electric cable as illustrated in FIGS. 1 or 2. Flowchart 36 illustrates a roll of wire 38 that may be a single electric conductor 22 or may have a group of electric conductors such as illustrated in FIG. 2 as numeral 20. That is, the roll 38 may dispense a single bare electric conductor 22, or may dispense a group of plural insulated electric conductors 20. Alternatively, a series of rolls 38 may each dispense a single insulated electric conductor 20 and the entire series may result in the plural cables 20 for the multi-strand electric cable as illustrated in FIG. 2. From the roll 38, the conductors go into a wrapping section 40 where a glass fiber wrap is disposed around their outer periphery. An impregnating section 42 has a motor that pulls the wire through the wrapping section. At the impregnating section 42, a first silicone compound is impregnated into the yarn that has been previously wrapped about the electric conductor. It may be preferable in some instances to have a pulling section pulling the wire intermediate the wrapping and impregnating sections rather than having the impregnating section solely doing the pulling. From the impregnating section, the wire then travels into a drying section 44 where the silicone compound that has been impregnated into the wrap 24 is dried. As the wire leaves the drying section 44 it enters a coating section 46 where a second silicone compound is coated about the outer periphery of the impregnated wrap. The wire leaves this coating section 46 and then enters a second drying section 48 where the silicone coating is again dried. From drying section 48 the wire enters a coiling section 50 where it is placed back on coils for distribution. A control 52 controls the various motors and pumps that will be necessary to move the wire and insert the silicone compounds to the various sections.

Figure 4:
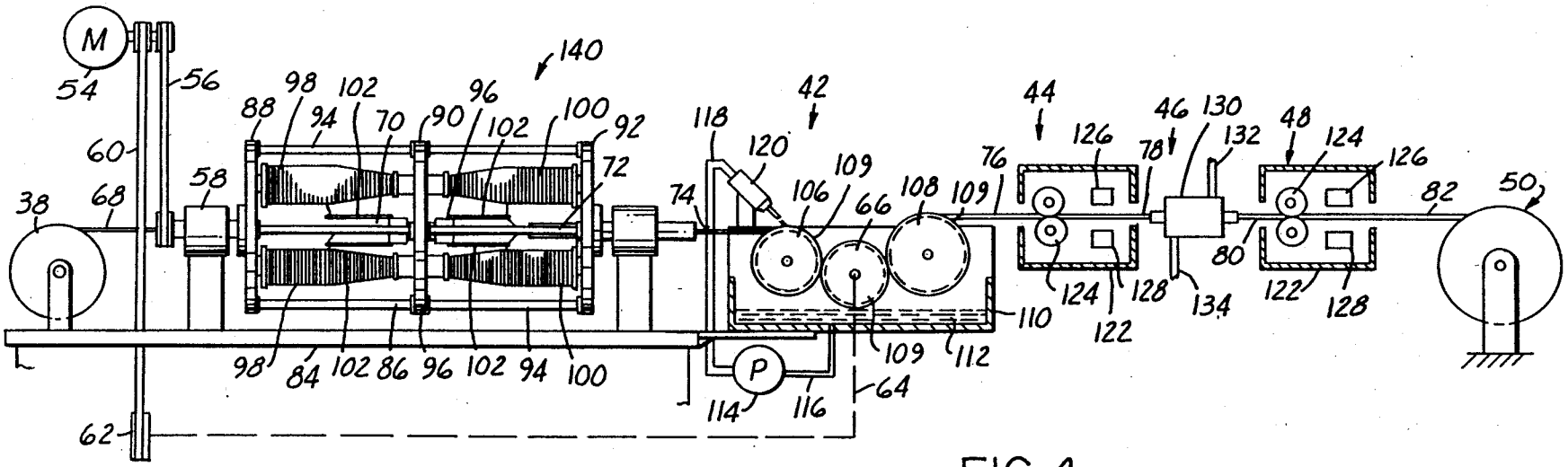
FIG. 4 illustrates an embodiment of machinery that may be used to create the improved cable of the present invention.

A machine for accomplishing the process shown in FIG. 3 is illustrated in FIG. 4. As shown in FIG. 4, wire roll 38 is a standard roll rotatably mounted upon a fixed body or support. A motor 54 is shown as driving the motors associated with the wrapping section 40 and the impregnating section 42. Motor 54 drives a belt 56 that drives a driven element 58. Motor 54 also drives a second belt 60 that drives a second driven element 62 that in turn drives a flexible transmission 64 to drive a driven disc 66 in the impregnating section 42. Wire leaves wire roll 38 at 68 and enters wrapping section 40. Wire 68 with a single wrap of yarn is illustrated at 70 and this continues on through the wrapping section 40 to a second yarn wrapping station. Twice wrapped wire is illustrated at 72. Wire leaves the wrapping section 40 and at 74 enters the impregnating section 42. Wire 76 then leaves the impregnating section 42 and continues on to the drying section 44 and therethrough at 78 enters into coating section 46. Wire leaves coating section 46 and at 80 is seen to enter the second drying section 48. The wire leaves the second drying section 48 at 82 and is then coiled on wire coil 50.

A fixed stand or support 84 mounts the wire roll 38, the motor 52 and the driven element 58. A carriage 86, that is part of wrapping section 40 is rotatably mounted upon stand 84. Carriage 86 comprises three plates, a first end plate 88, a central plate 90 and a second end plate 92. Bars 94 connect end plate 88 and central plate 90 and central plate 90 and second end plate 92. Guide elements 96 are mounted on both faces of central plate 90, one facing each of the end plates 88, 92. A first group of spools of glass fiber yarn that are wound along a first direction are illustrated at 98 and a second group of spools of glass fiber yarn that are wrapped in the opposed direction are illustrated at 100. Eyelets 102 extend from guide elements 96 and are each associated with an individual spool of yarn 98, 100.

Figure 5:
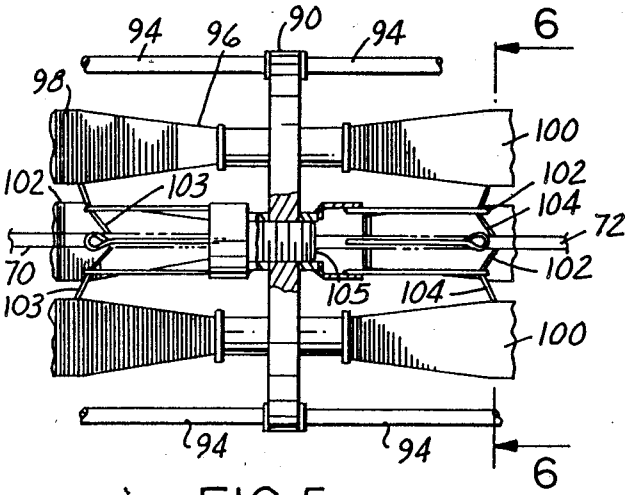
FIG. 5 is an enlarged section of a portion of the machine illustrated in FIG. 4.

As can best be seen from FIG. 5, yarn leaves spool 98 at a mid-point thereof and is guided through eyelet 102. The yarn is illustrated at 103 as being wrapped upon wire 70 in a first orientation. Spool 100 has yarn wrapped upon it in an opposed direction and this yarn is shown as leaving spool 100 and being guided through eyelet 102. The yarn is illustrated at 104 as being wrapped around wire 72. It is to be understood that the opposed orientation of spool elements 98 and 100 result in a first wrapping of yarn that surrounds the wire 70 in a first orientation and a second wrap of yarn around this first wrap in a second orientation. The first orientation may be for instance, clockwise while the second orientation may be counter clockwise.

The wire is pulled through the wrapping section 40 by the impregnating section 42. As the wire is pulled through the wrapping section, the wrapping section carriage 86 is driven by driven element 58. As carriage 86 rotates, plates 88, 90, 92, bars 94, spools 98 and 100, guide elements 96 and eyelets 102 all rotate as a unit. The relative speed of rotation of carriage 86 and the pulling speed of the wire is selected to ensure an adequate wrap of glass fiber yarn about the wire. Driven element 58 and plates 88, 90 and 92 each have a central bore that allows the wire 68, 70, 72 to pass therethrough. The bore in central plate 90 is illustrated at 105 in FIG. 5. Thus, the wire is not rotated with the carriage 86 but is pulled along through the wrapping section 40 by impregnating section 42. As the wire is pulled through the wrapping section 40, the carriage 86 is driven by driven element 58 and yarn is wrapped around wire 70 in a first orientation at 103 and then downstream in a second orientation at 104. The wire thus leaves the wrapping section at 74 with a yarn wrap about its outer periphery.

For multi-strand cable the strands may be initially tied together to begin the wrapping of the strands. The glass fiber yarn is glued to the wire to begin the wrapping process.

Figure 6:
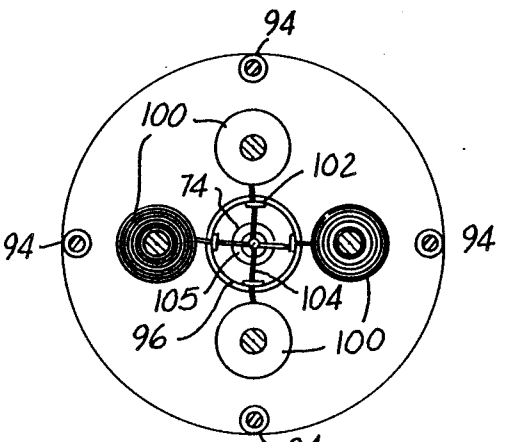
FIG. 6 is a cross-section taken along line 6—6 of FIG. 5.

As illustrated in FIG. 6, central plate 90 has bars 94 extending from it towards the second end plate 92 and a guide element 96 fixed to a central portion thereof. Spools 100 can be seen as being mounted at four circumferentially spaced positions on central plate 90 and eyelets 102 can be seen as being associated with each of spools 100 and being fixed to guide element 96. As can be seen, the wire 74 extends through core 105 and is wrapped at 104 with the four strands of glass fiber yarn.

Returning now to FIG. 4, the impregnating section will be further explained. As described above, the impregnating section 104 consists of a first driven disc 66 that is driven by motor 54. Second disc 106 and third disc 108 are idler discs and are mounted parallel to driven disc 66 on each side thereof. Discs 66, 106 and 108 are each formed with an outer rim 109 that has a groove at its outer periphery to receive the wrapped wire 74. A tank 110 is mounted below the discs 66, 106, 108 and contains a bath 112 of a first silicone compound. The level of silicone compound 112 is preferably kept below the lower most extent of the discs 66, 106, 108. Pump 114 is mounted below tank 110 and is connected to silicone bath 112 by an inlet 116. Pump outlet 118 leads from pump 114 to an injector 120 that may be a small needle, such as a hyperdermic needle.

As wire 74 is pulled by driven disc 66 over idler discs 106 and 108, pump 114 sends silicone compound from bath 112 through outlet 118 to injector 120 and the silicone compound is injected onto the glass fiber yarn. It is preferred that only enough compound is injected onto the yarn so as to impregnate a portion of the outer periphery thereof. The compound is prevented from entering the inner periphery of the yarn since this would create an insulation that would be difficult to strip away from the electric conductor. Wire 74 with a wrap that has been impregnated by silicone compound at its outer periphery is then squeezed between discs 66 and 106 in grooves 109. Wire 74 then travels about the lower outer periphery of driven disc 66 and is squeezed between disc 66 and 108 again in grooves 109.

The squeezing by the disc impregnates the yarn. It is not necessary to accurately meter the compound since any excess would merely fall back into bath 112. It is preferred that only three discs be utilized since a greater number could result in the impregnation going too deep.

The wrapped impregnated wire then leaves impregnating section 42 at 76 and is pulled into a drying section 44 by rollers 124. Drying section 44 has an outer housing 122 and opposed silicone rollers 124. It is preferred that silicone compounds are used to create rollers 124 since the drying section 44 will be at a high temperature and silicone has resistance to these high temperatures. Within drying section 44 are two conventional heat lamps 126 and 128. Other types of drying elements may be utilized.

The wrapped, impregnated, dried cable then leaves drying section 44 at 78 and enters a second coating section 46.

A first embodiment of a coating section will now be described with reference to FIG. 7. The second coating section 46 has outer housing 130 and receives a second silicone compound through a first port 132. This second silicone compound is preferably inserted into the housing 130 at a pressure of approximately 40 psi. The compound enters into a chamber 136 where it is allowed to circulate about the electric cable 78 and then leaves through a second port 134. It is important to maintain the circulation of the silicone compound to prevent set-up of the compound. Electric cable 78 is still at a raised temperature since it was recently in drying section 44 and the heated cable attracts the silicone compound to ensure a good outer coating. In an example, the wire was maintained at 450°-500° F. and the silicone compound at 0° F. This also helps prevent the compound from setting up. These temperatures are applicable to all the coating section embodiments. It may be preferable to include an additional heating section between drying section 44 and coating section 46 to ensure that cable 78 is at a desired temperature. It is to be understood that control valves are placed in lines 132, 134 to control flow therethrough.

Figure 7:
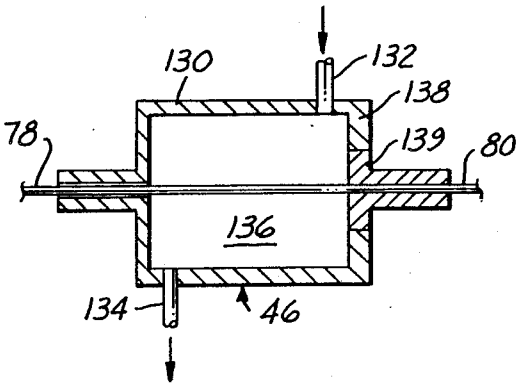
FIG. 7 is an enlarged portion of the machine illustrated in FIG. 4 showing the coating section.

FIG. 7 illustrates a coating section that is preferably used when making multi-strand cable 32. Coating housing 130 consists of a main portion 138 that receives a plug member 139. The use of a plug, such as member 139 allows easy access into housing 130 for cleaning or the like.

The wrapped, impregnated, dried, coated wire leaves second coating section 46 at 80 and enters a second drying section 48 that is identical to first drying section 44. The wire leaves this second drying section 48 at 82 and is wound on coil 50.

Figure 8:
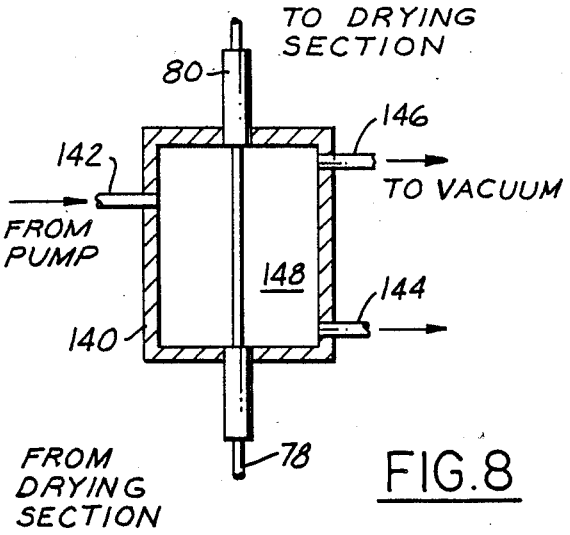
FIG. 8 is an alternative embodiment for the coating section of the machine illustrated in FIG. 4.

The second embodiment of the second coating section 46 is illustrated in FIG. 8. This embodiment is preferably used when making single strand cable 20. This coating section 140 has a coating inlet 142 and a coating outlet 144. A line 146 leads to a vacuum pump. Coating section 140 is preferably mounted extending vertically upwardly. That is, when using coating section 140 it is preferable that the wire leaving drying section 44 is turned directly vertically upwardly into coating section 140. Thus, as illustrated, coating section 140 has coating outlet 144 at a lower most vertical position, coating inlet 142 at an intermediate vertical position and a line to vacuum 146 at an uppermost vertical position. Wire 78 can be seen to be entering modified coating section 140 at 78 and leaves modified coating section 140 at 80. When using this modified coating section, the rest of the flow chart 36 and apparatus is identical to that shown in FIGS. 3 and 4. It is envisioned that a third silicone compound may be preferably used when using coating section 140.

Coating section 140 is especially preferred for use in coating a single strand of electric wires such as illustrated in FIG. 1. When using coating section 140, a coating enters 142 into chamber 148 where it contacts the electric cable 78. Electric cable 78 is coated and the coating leaves through port 144. While the coating operation is in effect, vacuum line 146 is closed. When coating is interrupted, vacuum 146 is initiated and inlet 142 and outlet 144 are closed. The opening and closing of the lines is controlled by control valves (not shown) that are mounted in lines 142, 144, and 146. This combination prevents the coating from being exposed to any particular portion of wire for an overly long period of time. That is, if the cable 78 were left in coating section 140 for a period of time while the line is stopped, coating may build up on that particular section of cable and that would be undesirable. With the use of vacuum 146, no leakage coating will be allowed in chamber 148 while the line is stopped.

Figure 9:
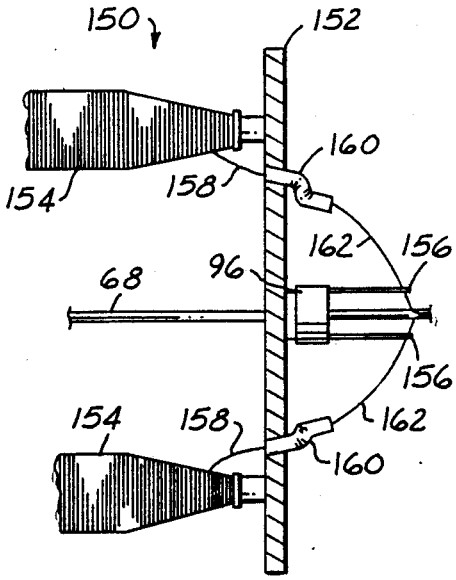
FIG. 9 is an alternative embodiment for the wrapping section of the machine illustrated in FIG. 4.

An alternative wrapping section 150 is illustrated in FIG. 9. Alternative wrapping section 150 has a central plate 152 upon which are mounted spools 154. Cable 68 leaves wire roll 38 similar to wrapping section 40. Guide elements 96 are mounted on central plate 156 and eyelets 156 extend from guide elements 96. Yarn at 158 can be seen to leave the axial end of spool 154 and extend through a S-shaped tube 160. S-shaped tube 160 causes the yarn 158 to go through a tortious series of turns that ensures adequate tension. Yarn at 162 leaves S-shaped tube 160 and is wrapped upon wire 68 similar to wrapping section 44. S-shaped tube 160 may be a clear plastic tube or the like.

Figure 10:
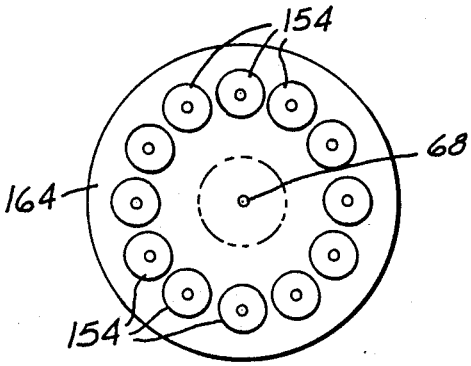
FIG. 10 is a cross-section of the alternative embodiment of the wrapping section illustrated in FIG. 9.

FIG. 10 illustrates first end plate 164 of alternative wrap section 150. As can be seen there are twelve spools 154 illustrated in alternative wrap section 150. Spools 154 may be arranged at the same radial extent, as illustrated in FIG. 10, or they may be staggered at various radial positions. In alternative wrap section 150, as illustrated in FIGS. 9 and 10, only a single wrap of glass fiber yarn is applied to cable 68. It is envisioned that a second opposed wrap may also be utilized with alternative wrap section 150, similar to the arrangement used in wrap section 40. However, it may be preferable that only a single wrap be placed upon the electric cable 68.

Figure 11:
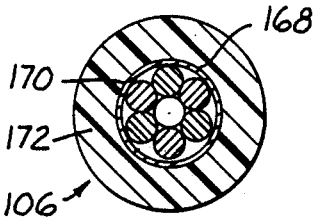
FIG. 11 is an alternative embodiment of the electric cable illustrated in FIG. 2.

A third type of electric cable 166 is illustrated in FIG. 11. Cable 166 consists of a series of electric conductors 168 similar to that illustrated in FIG. 2, however, rather than using a glass fiber yarn wrap a silicone tape 170 is wrapped about conductors 168. This silicone tape is formed from a silicone compound such as is associated with the various impregnating or coating sections and is made by commonly known processes. An outer coating 172 is placed about silicone tape 170 similar to the coating 46 utilized with the other types of wire.

Figure 12:
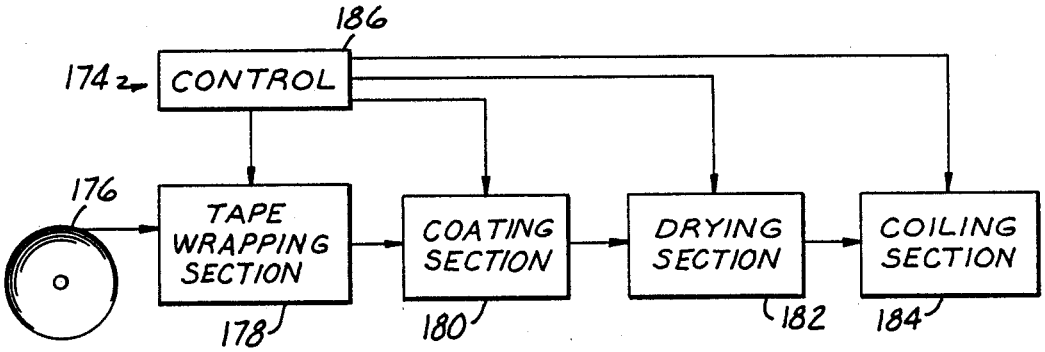
FIG. 12 is a flowchart of the process that will be utilized to create the alternative embodiment of electric cable illustrated in FIG. 11.

With reference to FIG. 12, a flowchart for producing this third embodiment of wire will be explained. Wire roll 176 contains wire similar to wire roll 38 in the first embodiment. A tape wrapping section 178 contains a tape wrapping machine that wraps the silicone tape around the several electric conductors. Tape wrapping machines are well known for wrapping tape about electric conductors, however, they have not been used with silicone tape. From tape wrapping section 178 the wire goes to coating section 180 that is similar to either of the two coating sections previously described, or, the third coating section described below. The coated cable then enters drying section 182, again similar to previously described drying sections. From drying section 182 the cable goes to coiling section 184 similar to the previously described coiling section. Control 186 controls the various sections of this process.

Figure 13:
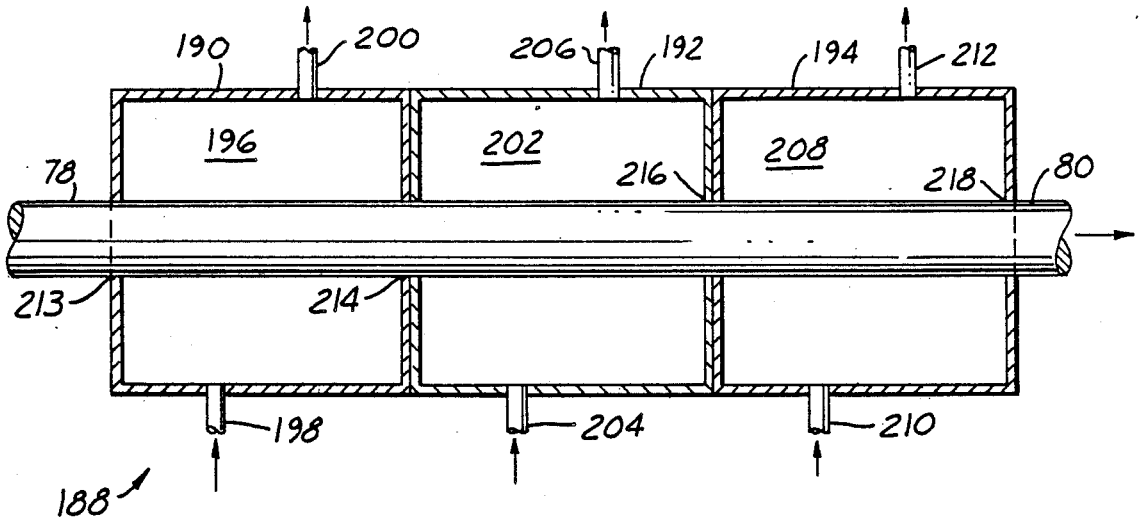
FIG. 13 illustrates an alternative embodiment of the coating section of the machine illustrated in FIG. 4.

A third embodiment of the coating section can be seen in FIG. 13. This coating section 188 is preferably used with a multi-strand cable such as illustrated in FIG. 2. Coating section 188 consists of a first coating portion 190, an intermediate cooling portion 192 and a second coating portion 194. First coating portion 190 consists of chamber 196 that surrounds the electric cable and an inlet 198 that receives pressurized silicone compound into chamber 196. The compound is circulated within chamber 196 to prevent it from setting up, and eventually exits through exit 200.

The intermediate cooling section 192 consists of a chamber 202 that surrounds the cable and an inlet 204 that supplies cooling fluid to chamber 202. In a preferred embodiment of this invention, this cooling fluid may consist of water with an additive that has good thermal transfer characteristics, as an example ordinary anti-freeze may be utilized. The cooling fluid circulates through chamber 202 and exits through port 206.

Second coating portion 194 has chamber 208 again surrounding the cable and port 210 supplies the silicone compound to the chamber 208. The fluid circulates within chamber 208 and exits through port 212.

The wire at 78 enters coating portion 188 through port 213 and is coated within chamber 196. As the wire leaves chamber 196 it goes through guide port 214 separating first coating portion 190 from cooling portion 192. The size of the orifice at guide opening 214 is chosen to be slightly larger than the orifice at opening 213 to accommodate the extra diameter of the wire due to the coating. As an example, it may be 0.015 inches larger in diameter. Wire leaves cooling chamber 202 through guide opening 216 and enters second coating portion 194. The cable is coated in second coating portion 194 and exists through guide opening 218 at 80. Guide opening 218 is chosen to be slightly larger in diameter than opening 214 or 216, again to accommodate the extra diameter that the wire will now have due to the coating that has been applied in second coating portion 194. The cable at 80 is pulled through the coating section 188 by a force of approximately 150 foot pounds of tension. It is necessary to apply such a large force to pull the wire through coating section 188 since the guide openings 213, 214, 216 and 218 must be approximately the same diameter as the wire to ensure good sealing between chamber 190, 192 and 194. In a preferred embodiment, the rollers 124 in drying section 48 will provide the tension to pull the cable through the coating section 188. Lines 198, 200, 204, 206, 210 and 212 may all be provided with control valves.

The various silicone compounds utilized with the processes will now be described.

A first compound is envisioned for use with the impregnating section and consists of a silicone compound diluted with a thinner. For the silicone compound, any type of high voltage insulator coating that is silicone based may be utilized. Preferably, a vulcanizing silicone rubber is utilized. Most preferably, an amine or oxime cure room temperature vulcanizing silicone rubber with at least 50%, and up to a miximum of 58%, of alumina trihydrate for fire retardancy. As an example, Sylgard TM, available from Dow Corning, Midland, Michigan, may be utilized. For the thinner, an industrial solvent such as inhibited 1,1,1, trichloroethylene is desirable.

An example of this compound was produced by mixing 80 percent by volume of the silicone compound high voltage insulator coating and 20 percent by volume of the thinner, the trichloroethylene.

A second compound that is envisioned for use with the coating sections, in particular, the first and third embodiment of the coating section, consists of a silicone compound that is mixed with clay and alumina trihydrate. These two additives add flexibility and resiliency to the silicone compound. The silicone compound utilized with this second compound may be any type of silicone compound that has good characteristics as an electric insulator. Preferably, a liquid silicone rubber is utilized. An example may be Silastic TM, available from Dow Chemical Corning. This product consists of two compounds that are combined to initiate the setting up or curing of the product. The product is described in U.S. Pat. No. 3,445,420 entitled "Acetylenic Inhibited Platinum Catalyzed Organopolysiloxane Composition" issued to Kookootsedes, et al. The clay is dried, pulverized and sifted until very fine.

A particular clay that was utilized to make the below disclosed examples of this compound consisted of 20 to 30 percent of illite, 10 to 15 percent of vermiculite, 10 to 15 percent of kaolimite, 10 to 15 percent of quartz, less than 5 percent of feltspars, 5 to 10 percent of calcite and 10 to 15 percent of dolomite. These percentages are from the dried material and not the original moist clay.

In addition, the following densities of materials were used for the_below disclosed examples. The clay weighted 1.24 pounds per pint. The Silastic TM compound weighed 1.84 pounds per pint. The Sylgard TM compound weighed 1.26 pounds per pint.

An example of this compound was produced by mixing 60 percent by volume of the Silastic TM compound, 30 percent by volume of the dry sifted clay and 10 percent by volume of the alumina trihydrate.

The clay, the alumina trihydrate and the two compounds that make up the Silastic TM compound were mixed and stored in a container that was maintained at 0° F. for at least twenty-four hours. A vacuum was applied to the container to remove air bubbles. The compound was then ready for use.

A third compound is envisioned for use with the coating, in particular for the alternative coating illustrated at FIG. 8. This third coating consists of a silicone compound, clay and alumina trihydrate. It is envisioned that the same silicone coating utilized with the first compound may be utilized with this third compound. The clay and alumina trihydrate are similar to that used with the second compound.

An example of this third compound was produced by mixing 80 percent by volume of the Sylgard TM compound, 15 percent by volume of the dry sifted clay and 5 percent by volume of the alumina trihydrate.

The clay and alumina trihydrate were initially mixed. A small percentage of the Sylgard TM compound was stirred into the powders to create a paste. The remainder of the Sylgard TM compound was then stirred in the mixture. The compound may be exposed to some means for maintaining circulation while it is stored but preventing it from settling-up.

The tape and dryer rollers are preferably formed from a product similar to Silastic TM.

An example of this third compound was produced by mixing 80 percent by volume of the silicone compound, 15 percent by volume of the dry sifted clay and 5 percent by volume of the alumina trihydrate.

A working embodiment of the present invention has been disclosed, however, certain modifications of the invention would be envisioned by one of ordinary skill in the art. The intended scope of the present invention can be best understood from the appended claims.

We claim:

1. An electric cable comprising:
at least one electric conductor;
glass fiber yarn being wrapped around said electric conductor, said glass fiber yarn having an inner periphery that contacts said electric conductor;
said glass fiber yarn being impregnated by a first silicone mixture, said first silicone mixture being impregnated into the outer periphery of said glass fiber yarn, said inner periphery of said glass fiber yarn being unimpregnated such that said first silicone mixture does not contact said conductor; and
a second silicone mixture coating disposed about the outer periphery of said glass fiber yarn.

2. An electric cable as recited in claim 1, and wherein said first silicone mixture coating is a distinct material from said second silicone mixture.

3. An electric cable as recited in claim 2, and wherein said second silicone mixture is a mixture of a silicone mixture, clay and alumina trihydrate.

4. An electric cable as recited in claim 1, and wherein said first silicone mixture coating is a distinct material from said second silicone mixture.

5. An electric cable as recited in claim 1, and wherein there is only one of said electric conductors.

6. An electric cable as recited in claim 1, and wherein there are several of said electric conductors, each having an individual insulation within said glass fiber yarn.

7. An electric cable comprising:
a plurality of electric conductors;
an outer glass fiber yarn being wrapped around said plurality of electric conductors, said outer glass fiber yarn having an inner periphery that contacts said electric conductors;
said electric conductors each having an individual insulation within said outer glass fiber yarn; and
each of said individual insulations of said plurality of electric conductors comprising an individual insulation glass fiber yarn wrapped around said electric conductors, said individual insulation glass fiber yarn having an inner periphery that contacts said electric conductor, said individual insulation glass fiber yarn being impregnated by a first silicone mixture, said first silicone mixture being impregnated into the outer periphery of said individual insulation glass fiber yarn, but not impregnated into the inner periphery of said individual insulation glass fiber yarn, a second silicone mixture coating disposed about the outer periphery of said individual insulation glass fiber yarn, said first silicone mixture and said second silicone mixture being of distinct materials.

8. A multi-strand electric cable comprising:
a cable;

a plurality of individually insulated conductors at the center of said cable;

a glass fiber yarn wrapped about the circumference of said plurality of individually insulated conductors and having an inner periphery that contacts said conductors;

said glass fiber yarn being impregnated by a first mixture, said first mixture comprising a silicone rubber, said first mixture being impregnated into the outer periphery of said glass fiber yarn, said inner periphery of said glass fiber yarn being unimpregnated; and an outer coating about the outer periphery of said glass fiber yarn, said outer coating comprising a silicone rubber.

9. A multi-strand cable as recited in claim 8, and wherein said outer coating comprises clay and alumina trihydrate.

10. A multi-strand cable as recited in claim 8, and wherein said glass fiber yarn consists of a first portion in a first orientation and a second portion wrapped in an opposed orientation.

* * * * *